US007676283B2

(12) United States Patent
Liepold et al.

(10) Patent No.: US 7,676,283 B2
(45) Date of Patent: Mar. 9, 2010

(54) METHOD FOR OPTIMIZING THE FUNCTIONING OF A PLURALITY OF COMPRESSOR UNITS AND CORRESPONDING DEVICE

(75) Inventors: Helmut Liepold, Gremsdorf (DE); Michael Metzger, Markt Schwaben (DE)

(73) Assignee: Siemens Aktiengesellschaft, Munich (DE)

( * ) Notice: Subject to any disclaimer, the term of this patent is extended or adjusted under 35 U.S.C. 154(b) by 187 days.

(21) Appl. No.: 11/815,956

(22) PCT Filed: Feb. 2, 2006

(86) PCT No.: PCT/EP2006/050612

§ 371 (c)(1),
(2), (4) Date: Aug. 9, 2007

(87) PCT Pub. No.: WO2006/084817

PCT Pub. Date: Aug. 17, 2006

(65) Prior Publication Data

US 2008/0131258 A1 Jun. 5, 2008

(30) Foreign Application Priority Data

Feb. 11, 2005 (DE) ..... 10 2005 006 410

(51) Int. Cl.

| | |
|---|---|
| ***G05B 13/02*** | (2006.01) |
| *G05D 3/12* | (2006.01) |
| *G05D 5/00* | (2006.01) |
| *G05D 9/00* | (2006.01) |
| *G05D 11/00* | (2006.01) |
| *G05D 17/00* | (2006.01) |
| *G05B 13/00* | (2006.01) |

(52) U.S. Cl. ..... 700/28; 700/29; 700/30; 700/291; 318/561; 60/236

(58) Field of Classification Search ..... 700/28–30, 700/291; 318/561; 60/236
See application file for complete search history.

(56) References Cited

U.S. PATENT DOCUMENTS 3,665,399 A * 5/1972 Zehr et al. ..... 340/870.09

(Continued)

FOREIGN PATENT DOCUMENTS

DE 3937152 A1 5/1991

(Continued)

OTHER PUBLICATIONS

P. E. Gill et al., Practical Optimization, Academic Press, London, 409 pages, 1995.

(Continued)

*Primary Examiner*—Ramesh B Patel
(74) *Attorney, Agent, or Firm*—King & Spalding L.L.P.

(57) ABSTRACT

In a method for controlling a compression installation (1), the installation has at least two compressor units (i=1, , N) that can be separately turned on or off, a plurality of devices for modifying the output of the compressor units and a control device (10). Known methods and devices do not function optimally in terms of the power consumption of the entire compression installation. The power consumption (EG) for the operation of a plurality of compressor units (i=1, , N) of a compression installation (1) can be optimized by calculating a novel circuit configuration (Si, t) and automatically adjusting the novel circuit configuration (Si, t) by a control device (10).

26 Claims, 4 Drawing Sheets

U.S. PATENT DOCUMENTS

| | | | | |
|---|---|---|---|---|
| 4,640,665 | A | 2/1987 | Staroselsky et al. | 415/1 |
| 5,108,263 | A | 4/1992 | Blotenberg | 417/2 |
| 5,743,714 | A | 4/1998 | Drob | 417/2 |
| 5,749,238 | A * | 5/1998 | Schmidt | 62/211 |
| 6,535,795 | B1 * | 3/2003 | Schroeder et al. | 700/266 |
| 2001/0015918 | A1 * | 8/2001 | Bhatnagar | 365/200 |
| 2001/0045101 | A1 * | 11/2001 | Graham et al. | 62/236 |
| 2003/0161731 | A1 | 8/2003 | Blotenberg | 417/2 |
| 2004/0095237 | A1 * | 5/2004 | Chen et al. | 340/506 |
| 2004/0265133 | A1 | 12/2004 | Lau | 417/7 |

FOREIGN PATENT DOCUMENTS

| | | | |
|---|---|---|---|
| DE | 10208676 | A1 | 9/2003 |
| EP | 0431287 | A | 11/1993 |
| EP | 0576238 | B1 | 9/1997 |
| EP | 0769624 | B1 | 12/2001 |
| EP | 1340919 | A | 9/2003 |
| JP | 62243995 | A | 10/1987 |
| WO | 03036096 | A | 5/2003 |

OTHER PUBLICATIONS

R. G. Carter, Compressor Station Optimization: Computational Accuracy and Speed, 24 pages, 1996.

S. Wright et al., Compressor Station Optimization, Pipeline Simulation Interest Group, Denver, Colorado, 39 pages, 1998.

L. A. Wolsey, Integer Programming, John Wiley & Sons, New York, 142 pages, 1998.

K. Ehrhardt et al., Nonlinear Optimization In Gas Networks, ZIB-Report 03-46, Berlin, 10 pages, 2003.

International Search Report PCT/EP2006/050612, 6 pages, May 23, 2006.

Written Opinion of the International Searching Authority Supplemental Sheet, PCT/EP2006/050612, 2 pages, May 23, 2006.

T. Jenicek et al., Optimized Control Of Generalized Compressor Station, 21 pages, 1995.

* cited by examiner

METHOD FOR OPTIMIZING THE FUNCTIONING OF A PLURALITY OF COMPRESSOR UNITS AND CORRESPONDING DEVICE

CROSS-REFERENCE TO RELATED APPLICATIONS

This application is a U.S. national stage application of International Application No. PCT/EP2006/050612 filed Feb. 2, 2006, which designates the United States of America, and claims priority to German application number 10 2005 006 410.8 filed Feb. 11, 2005, the contents of which are hereby incorporated by reference in their entirety.

TECHNICAL FIELD

The invention relates to a method for controlling a compressor plant having at least two compressor units which can be connected and/or disconnected separately, having a plurality of devices for changing the operating output of the compressor units and having a control device.

Furthermore, the invention relates to a control device for controlling a compressor plant having at least two compressor units which can be connected and/or disconnected separately and having a plurality of devices for changing the operating output of the compressor units.

BACKGROUND

Compressor plants, for example natural gas compressor plants, for gas transport and/or gas storage are important devices in the sense of the national and international energy supply. A system for gas transport comprises a large number of compressor loans, which in each case can be composed of a plurality of compressor units. Here, the compressor units are given the task of adding sufficient mechanical energy to a conveyed medium in order to compensate for friction losses and to ensure the necessary operating pressures and flows. Compressor units often have very different drives and impellers, since they are for example designed for base load or peak load operation. A compressor unit comprises, for example, at least one drive and at least one compressor.

The automation of plant is given great significance, in particular for operation with optimal costs. The capability of the plant automation system to manage the process and to optimize the compressor plant within the production restraints supplies decisive economic advantages.

The compressors of a compressor plant are frequently driven by turbines which cover their fuel requirements directly from a pipeline. Alternatively, compressors are driven by electric motors. Operation with optimal costs means minimizing the power consumption of the turbines or the electric drives at a given compressor output, delivery output, delivery capacity and/or with a given volume flow.

A usable operating range of compressors is restricted by disadvantageous effects of internal flow processes. This results in operating limits, such as a temperature limit, exceeding the local speed of sound (compressor surge, absorption limit), the circumferential breakdown of the flow at the impeller or the pump limit.

The automation of a compressor plant primarily has the task of implementing set points predefined by a central dispatching facility, such as optionally a flow through the station or final pressure at the output side, as actual values. In this case, predefined limiting values for the intake pressures on the inlet side, the final pressures on the outlet side and the final temperature at the outlet from the plant must not be exceeded.

WO 03/036096 A1 discloses a method for optimizing the operation of a plurality of compressor units of a natural gas compression station. In this method, after a second or a further compressor unit has been started up, the rotational speeds of the running compressor units are run in a fixed rotational speed relationship in relation to characteristic map data for each compressor unit. In order to implement a first reduction in the energy consumption, after an additional compressor has been started up, the rotational speeds of all the units that are operating are changed by an equal-percentage flow rate adjustment until, if possible, all the pump protection valves in the plant are closed. Only after the all pump protection valves have been closed are working points of the compressor units in their characteristic maps displaced as close as possible to a line of maximum efficiency.

According to EP 0 769 624 B1, a method is known for load compensation between a plurality of compressors and for manipulating the working output of the compressors in order to maintain a predetermined relationship between all the compressors if the working points of all the compressors are further from the pump limit than a specified value.

EP 0 576 238 B1 discloses a method and a device for load distribution. Using a compressor intended as a reference compressor, a control signal is generated which is used as a reference variable for the non-reference compressors.

SUMMARY

The above-described methods are not yet able to reduce the energy consumption of the entire compressor plant satisfactorily.

A method and a device for the further optimization of the energy consumption for an operation of a plurality of compressor units of a compressor plant can be provided.

According to an embodiment, a method for controlling a compressor plant having at least two compressor units which can be connected and/or disconnected separately, having a plurality of devices for changing the operating output of the compressor units and having a control device, may comprise the steps of: in the event that new set points are predefined or there is a change in the current state of the compressor plant, using an optimization calculation to calculate new switching configuration from a current switching configuration of the compressor units, with regard to an optimized total energy demand of the compressor plant, and set the new switching configuration automatically via the control device.

According to another embodiment a control device for controlling a compressor plant may comprise at least two compressor units which can be connected and/or disconnected separately and having a plurality of devices for changing the operating output of the compressor units, an optimization module, with which, in the event that new set points are predefined or there is a change in the current state of the compressor plant, using an optimization calculation, a new switching configuration can be calculated from a current switching configuration of the compressor units, with regard to an optimized total energy demand of the compressor plant, and an actuating module, with which the new switching configuration can be set automatically.

BRIEF DESCRIPTION OF THE DRAWINGS

In the following text, the invention will be explained in more detail by using an exemplary embodiment, FIG. 1 showing a block diagram of a method for optimizing the operation of a compressor plant, FIG. 2 showing a compressor-specific characteristic map of a compressor unit, FIG. 3 showing a control device for controlling a compressor plant, and FIG. 4 showing a flowchart of the method steps.

DETAILED DESCRIPTION

Figure 1:
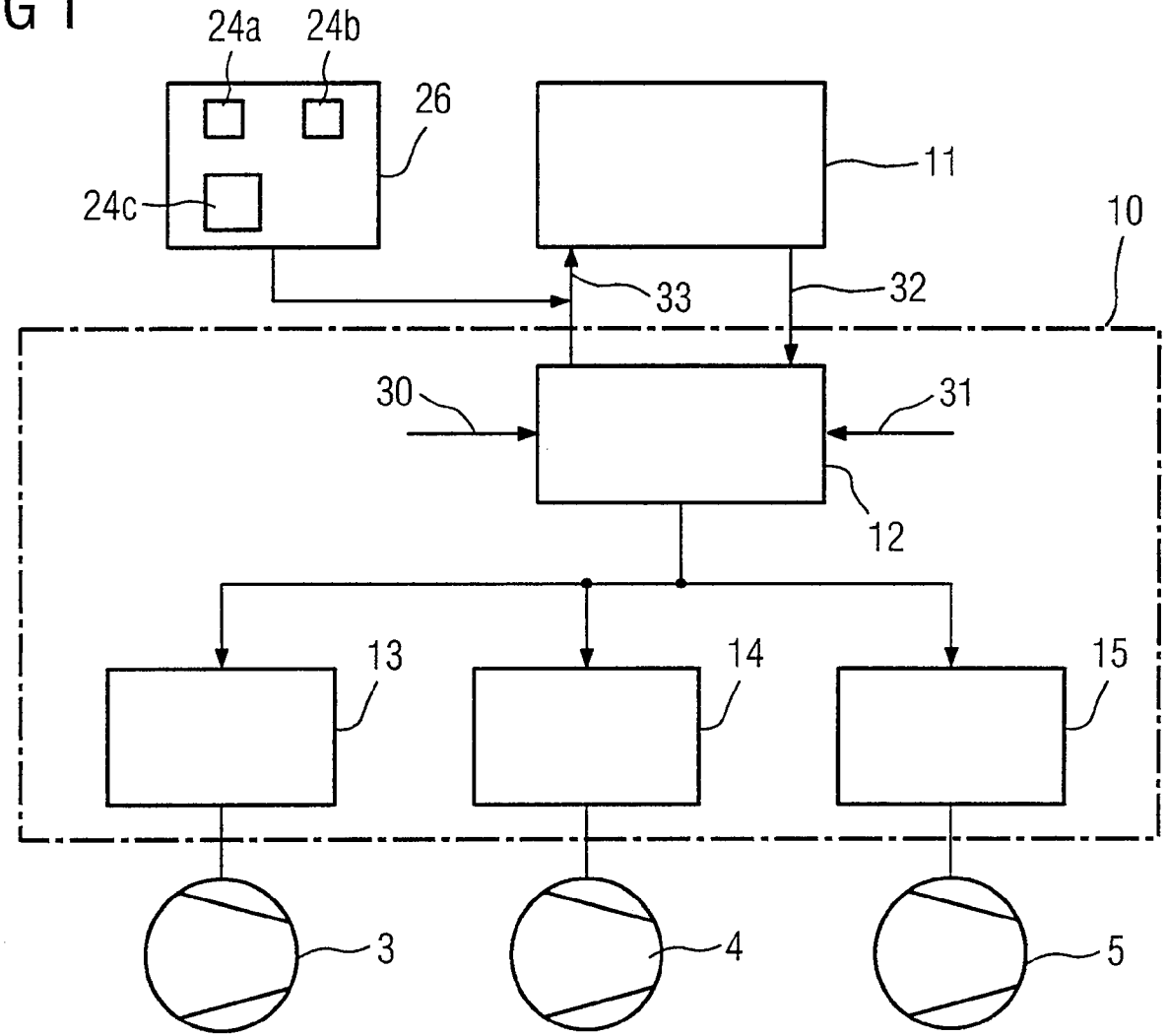

According to various embodiments, in the event that new set points are predefined or there is a change in the current state of the compressor plant, using an optimization calculation, a new switching configuration is calculated from a current switching configuration of the compressor units, with regard to an optimized total energy demand of the compressor plant, and in that the new switching configuration is set automatically via the control device.

According to various embodiments, it can be advantageous that, during the optimization, a start can be made from all the compressor units which are available or ready to operate in the respective compressor plant, irrespective of their respective operating or switching state. In particular, in contrast to conventional control systems, the various embodiments allow automatic connection of a compressor unit that was previously out of operation or the complete shutdown of a compressor unit as a result of the optimization.

In this case, automatically means, in particular, "online", which is to say automatically can mean for example that the switching configuration is used without any manual activity by operating personnel of the compressor plant, preferably in real time. Real time means that the result of a calculation is guaranteed to be present within a certain time period, that is to say before a specific time limit is reached. In this case, the optimization calculation can run on a separate data processing system, which passes on its computational data automatically to the control device.

The various embodiments are based on the known sequential concept, which means that, after an additional unit predefined from outside has been started up, first of all closing the pump protection valves and then optimizing the working points of the compressor units with regard to efficiency. According to an embodiment, during each optimization calculation, the entire compressor plant is preferably considered and the switching configuration of the compressor plant, that is to say the predefinition of a switching state of the individual compressor units, is calculated. The closure of the or all the pump protection valves can be ensured by a minimum flow through the compressor units during the optimization. In addition, first-time start-up of the compressor plant can even be carried out with a switching configuration which is beneficial with regard to an optimized total energy demand.

The switching configuration, which can preferably be manipulated electrically, of a compressor plant, is understood to mean a set of the respective switching states of the individual compressor units. The switching configuration is represented by the switching states "0" for off or "1" for on, which is stored, for example, bit by bit in an integer variable.

Switching operation is understood to mean the change from one, in particular electrical, switching state to another.

Advantageously, a forecast for at least one future time, preferably a plurality of future times, is determined using the optimization calculation. Since the method permits forecasts up to a given time, it is possible to use knowledge about normal running of the station, i.e. for example a conventional load course, in order to minimize the switching frequency of compressor units.

It is expedient that compressor unit-specific data sets and/or compressor unit-specific characteristic maps are evaluated and, for the individual compressor units, working points are determined, which depend on predefined or changed values of the mass flow and a specific delivery work, the working points being set in such a way that the total energy demand of the compressor plant is optimized.

The data sets and/or characteristic maps are advantageously specified as a function of a mass flow and a specific delivery work of the individual compressor units.

During the optimization calculation, in addition to the switching configuration, a load distribution, that is to say a rotational speed relationship, between the compressor units is advantageously calculated and is changed if necessary.

A further substantial advantage resides in the fact that secondary conditions on the optimization, such as not infringing pump limits, can already be taken into account during an optimal efficiency calculation of the rotational speed set points for the individual compressor stations.

It is expedient that the optimization calculation is carried out with a control cycle, in particular in a self-triggering manner.

Advantageously, with each control cycle, rotational speed set points and/or the new switching configuration for the control device are provided as output variables from the optimization calculation.

It is expedient that, for the duration of the control cycle, which, in particular, is a multiple of a cycle time of the control action of the control device, the rotational speed set points and/or the switching configuration are kept constant.

According to a further embodiment, the rotational speed set points are scaled with a common factor and used as a set point for a compressor unit controller.

A further increase in the effectiveness of the plant operation is achieved by the control device, using the new switching configuration, triggering a warm-up phase of the compressor units for the subsequent connection of a compressor unit that was previously out of operation, even before the end of the control cycle.

In a particular embodiment, with the end of the warm-up phase, a readiness to be loaded for the next control cycle is communicated to the control device. If, for example, the rotational speed of a starting compressor unit is sufficiently high and the warm-up phase of the turbine has been completed, a signal "load ready" is set. This means that the compressor unit participates in the method for load distribution and is taken into account in the optimization calculation for the most beneficial load distribution between the in operation.

In a further preferred embodiment, the following are evaluated as an input for the optimization calculation

- a model of the individual compressor units and/or
- a model library of the entire compressor plant, and/or
- a current specific delivery work of the individual compressor units and/or
- a current specific delivery work of the compressor plant and/or
- a current mass flow through the individual compressor unit, in particular through an individual compressor, and/or
- a current mass flow through the compressor plant and/or
- the current switching configuration and/or
- an intake pressure on the inlet side of the compressor plant and/or
- an intake pressure on the inlet side of the individual compressor unit and/or
- an end pressure on the outlet side of the compressor plant and/or an end pressure on the outlet side of the individual compressor unit and/or a temperature on the outlet side of the compressor plant and/or a temperature on the inlet side of the compressor plant and/or a temperature on the outlet side of the individual compressor units and/or a temperature on the inlet side of the individual compressor units and/or the current rotational speeds of the individual compressor units.

In an expedient way, the optimization calculation minimizes the total energy demand expected at a later time using forecast calculations in accordance with the principle of model-predictive control.

In a further preferred embodiment, an energy consumption of a switching operation is taken into account during the optimization calculation.

The energy consumption of the switching operation is expediently calculated from the data sets and/or the characteristic maps of the compressor units. The knowledge about a proportional energy consumption for the switching operation permits a more exact determination of the minimum total energy consumption of the compressor plant.

According to a further embodiment, the specific delivery work of the compressor plant is assumed to be constant for the control cycle, in particular when the compressor units are connected in parallel.

According to a further embodiment, the mass flow of the compressor plant is assumed to be constant for the control cycle, in particular when the compressor units are connected in series.

An active compressor unit is expediently operated at least with a predefinable or predefined minimum flow.

Advantageously, the optimization calculation is carried out using a branch and bound algorithm.

In a further advantageous way, a limit for the branch and bound algorithm is determined by solving a relaxed problem using sequential quadratic programming.

A further increase in the efficiency of the calculation method is achieved by the optimization calculation solving partial problems by means of dynamic programming, in particular in the case of series connection.

The object related to the device is achieved on the basis of the control device mentioned at the beginning by an optimization module, with which, in the event that new set points are predefined or there is a change in the current state of the compressor plant, using an optimization calculation, a new switching configuration can be calculated from a current switching configuration of the compressor units, with regard to an optimized total energy demand of the compressor plant, and by an actuating module, with which the new switching configuration can be set automatically.

The optimization module for optimizing the energy consumption is set up in particular, in combination with the control device and/or the central dispatching facility, to distribute the predefined total load to the individual compressor units in such a way that the station set points are implemented with the lowest possible energy consumption, that is to say with the maximum total efficiency. This comprises, for example, both the decision as to which compressor units are to be switched on and those which are to be switched off, and also the predefinition of how many of each of the active units are to contribute to the total output, that is to say the predefinition of the load distribution.

According to a further embodiment, the optimization module is arranged at a physical distance, in particular a plurality of km, from the control device.

According to an expedient refinement, the optimization module is set up to take into account an energy consumption of a switching operation.

A further refinement is that the optimization module is set up for the optimization calculation for a plurality of control devices of a plurality of compressor plants.

The various embodiments also include a computer program product containing software for carrying out such a method. Using a machine-readable program code on a data storage medium, DP systems can advantageously be set up to form an optimization module.

The behavior of an individual compressor unit 3, 4, 5 is modeled using a characteristic map 20; the characteristic map 20 describes its efficiency and its rotational speed as a function of its working point 22. The working point 22 is described using a state variable {dot over (m)}, which describes a mass flow through the compressor unit, and a specific delivery work which can be determined by equation 1

$$y = \frac{\kappa}{\kappa - 1} R T_E Z\left[(p_A / p_E)^{\frac{\kappa-1}{\kappa}} - 1\right] + \frac{c_A^2 - c_E^2}{2} + g \cdot (z_A - z_E) \quad \text{[Eq. 1]}$$

where

R is a specific gas constant,

κ is an isentropic exponent,

Z is a real gas factor, $c_E, c_A$ is a speed at the inlet and outlet of the compressor unit, $z_A, z_E$ is a height difference, $p_E$ an intake pressure, $p_A$ an end pressure, and $T_E$ is an inlet temperature.

The characteristic maps 20 are not provided by a closed formula. A delivery characteristic 21 and an efficiency characteristic 23 are determined from a measurement. At a constant rotational speed, the dependence of the delivery work and an efficiency $\eta_i$ on the volume flow $\dot{V}_i$ or mass flow $\dot{m}$ is determined at reference points.

In order to model the behavior of a compressor unit 3, 4, 5, in addition the operating limits, such as a pump limit 36, which is necessitated by the occurrence of specific flow phenomena in the compressor, must be recorded as a function of the rotational speed. From these reference points and the associated values for various rotational speeds, using suitable approaches, such as piece by piece polynomial interpolation or B splines, the characteristic maps 20 can be built up as a function of the mass flow $\dot{m}_i$ and specific delivery work $y_i$ and their area of definition.

In the case of compressor units 3, 4, 5 connected in series, the total delivery work is distributed in an optimal-energy manner to the individual compressor units 3, 4, 5, the mass flow through the compressors being assumed to be equal. For a formulation of a minimization problem, in particular in the case of a series circuit, equation 2 applies:

$$\min = \sum_{t \geq 0} \sum_{i=1}^{N} s_{i,t} \frac{y_{i,t} \dot{m}_{g,t}}{\eta_i(\dot{m}_{g,t}, y_{i,t})} + \delta \sum_{t>0} (s_{i,t} - s_{i,t-1})^2 \quad \text{[Eq. 2]}$$

In order to apply mathematical programming, equation 3 is viewed as a secondary equation condition:

the series circuit results from the fact that the sum of the specific delivery work of the compressors at every time must be equal to the delivery work of the station:

$$y_{g,t} = \sum_{i=1}^{N} y_{i,t},\ s_{i,t} y_{i,t}^{min}(\dot{m}_{g,t}) \le y_{i,t} \le s_{i,t} y_{i,t}^{max}(\dot{m}_{g,t}) \quad \text{[Eq. 3]}$$

In the case of parallel-connected compressors, the total flow has to be distributed to the individual compressor units 3, 4, 5, the specific delivery work of the compressor plant being taken as given for an optimization cycle R. For a formulation of a minimization problem, in particular in the case of a series circuit, equation 4 applies:

$$\min = \sum_{t \ge 0} \sum_{i=1}^{N} s_{i,t} \frac{y_{g,t} \dot{m}_{i,t}}{\eta_i(\dot{m}_{i,t}, y_{g,t})} + \delta \sum_{t>0} (s_{i,t} - s_{i,t-1})^2 \quad \text{[Eq. 4]}$$

In order to apply mathematical programming, equation 5 is considered as a secondary equation condition:

In the case of the parallel circuit, the sum of the individual flows at every time must be equal to the total flow delivered:

$$\dot{m}_{g,t} = \sum_{i=1}^{N} \dot{m}_{i,t},\ s_{i,t} \dot{m}_{i,t}^{min}(y_{g,t}) \le \dot{m}_{i,t} \le s_{i,t} \dot{m}_{i,t}^{max}(y_{g,t}) \quad \text{[Eq. 5]}$$

Since the total energy consumption is to be minimized, the minimization problem results as the sum of the consumption of all the compressor units 3, 4, 5.

A further term is linked additively to the minimization problem, which represents a target function. The costs of switching, that is to say the energy consumption of a switching operation, are taken into account in this way. At a given intake pressure $p_S$, an end pressure $p_E$, a temperature T and the mass flow $\dot{m}$, a proportional energy consumption for a switching operation of a compressor unit 3, 4, 5 can be calculated from the characteristic maps.

During the optimization of the target function, the following secondary inequality conditions are complied with:

An active compressor unit must maintain a minimum flow, in particular a minimum mass flow $\dot{m}_{i,t}^{min}$, in order not to infringe the pump limit. This minimum flow depends on the instantaneous delivery work of the compressor plant. Likewise, the mass flow must remain below a maximum permissible value $\dot{m}_{i,t}^{max}$.

Entirely analogous to the mass flow, in the case of compressors connected in series, upper and lower limits $y_{i,t}^{min}$ and $y_{i,t}^{max}$ apply to the specific delivery work.

The treatment of compressor plants having parallel and serial connected units is implemented in a standardized manner and requires no entirely different formulations of the minimization problem. A solution results directly from the mathematical formulation as an optimization problem.

FIG. 1 shows a block diagram of a method for optimizing the operation of a compressor plant. The compressor plant is illustrated highly schematically with three compressor units 3, 4 and 5. A parallel connection will be assumed for the connection of the compressor units 3, 4 and 5. The compressor units 3, 4 and 5 are controlled and regulated by a control device 10. The control device 10 comprises control action of the control device 12, a first compressor unit controller 13, a second compressor unit controller 14 and a third compressor unit controller 15. An optimization module 11 is connected bidirectionally to the control device 10. Using the optimization module 11, a nonlinear mixed integer optimization problem is solved. A mathematical formulation of the optimization problem is implemented in the optimization module 11. By using Eq. 4 with a number N=3 of the compressor units 3, 4 and 5 and a series of input variables 33, the optimization module 11 will provide output variables 32 optimized with regard to an optimized total energy consumption for the control action of the control device 12. The input variables 33 are composed of a model library 26 having a model 24*a*, 24*b*, 24*c* for each compressor unit 3, 4, 5 and process variables from the compressor plant.

Via actual values 30 and set points 31, the control action of the control device 12 is supplied with

- a current temperature $T_{g,A}$ on the outlet side of the compressor plant,
- a current temperature $T_{g,E}$ on the inlet side of the compressor plant,
- a current end pressure $p_{g,A}$ on the outlet side of the compressor plant,
- a current intake pressure $p_{g,E}$ on the inlet side of the compressor plant,
- a current volume flow $\dot{V}_i$ for I=1 . . . 3 in each case with a current temperature for inlet $T_{i,E}$ and outlet $T_{i,A}$ of a compressor unit,
- a current pressure $p_{i,E}$ and $p_{i,A}$, as actual values from the individual compressor units 3, 4, and 5.

The set points and limiting values 31 for the control action of the control device 12 are composed of a maximum temperature $T_{g,A,max}$, a pressure $p_{g,A_{(set\ point)}}$ and a volume flow $\dot{V}_{g_{(set,\ point)}}$ on the outlet side of the compressor plant, and a maximum intake pressure $p_{g,E_{(max)}}$ and $p_{g,A_{(max)}}$ on the inlet side and the outlet side of the compressor plant.

With the actual values 30 as process variables and the basic equation Eq. 1, the input variables 33 for the optimization module 11 are completed.

A minimum total energy demand is then calculated in the optimization module 11. For the compressor units 3, 4 and 5 arranged in parallel, the minimization problem is solved using a branch and bound algorithm (L. A. Wolsey, "Integer programming", John Wiley & Sons, New York, 1998), which processes discrete variables in a binary tree. In order not to have to evaluate all the branches of the binary search tree, a lower limit G for the minimum is determined by solving a relaxed problem using sequential quadratic programming (P. E. Gill, W. Murray, M. H. Wright, "Practical optimization", Academic Press, London, 1995).

Furthermore, specific problem classes and adapted problem formulations as well as efficient algorithms are implemented in the optimization module 11, as can be found in the following literature T. Jenicek, J. Kralik, "Optimized Control of Generalized Compressor Station";

S. Wright, M. Somani, C. Ditzel, "Compressor Station Optimization", Pipeline Simulation Interest Group, Denver, Colo., 1998;

K. Ehrhardt, M. C. Steinbach, "Nonlinear Optimization in Gas Networks", ZIB-Report 03-46, Berlin, 2003 and R. G. Carter, "Compressor Station Optimization: Computational Accuracy and Speed", 1996.

Figure 2:
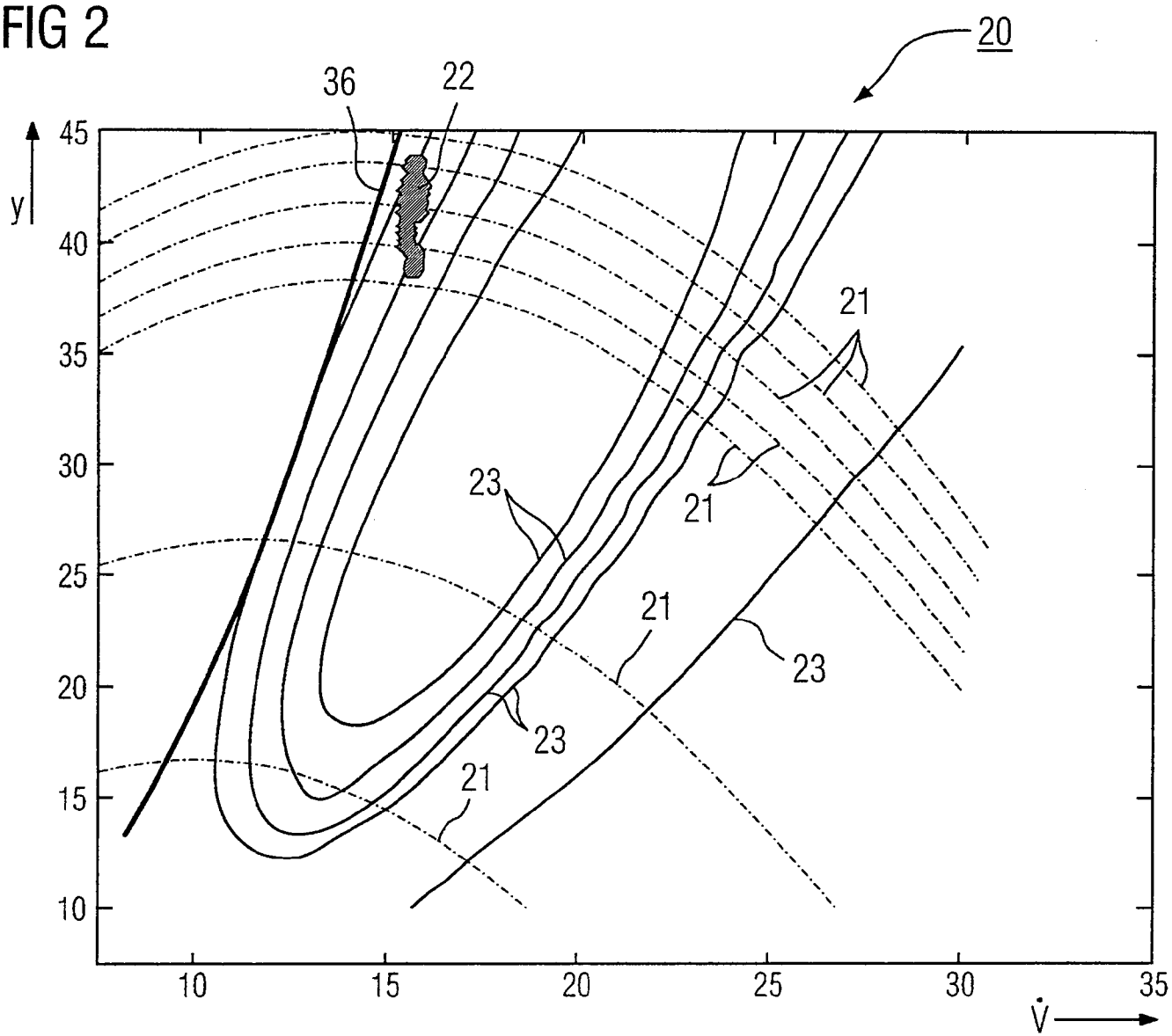

Starting from a continuous mode of operation of the compressor plant, working points 22 in characteristic maps 20, see FIG. 2, of the compressor units 3, 4 and 5 are kept in their optimal range.

In the event of a change in the volume flow $\dot{V}_{g(set,,point)}$ of the compressor plant, using the optimization calculation in the optimization module 11, a new switching configuration $S_{i,t}$ is calculated from a current switching configuration $S_{i,t-1}$ of the compressor units 3, 4 and 5, with regard to an optimized total energy demand of the compressor plant.

A reduction of one half in the volume flow $\dot{V}_{g(set\ point)}$ of the compressor plant results in an optimization calculation result which predefines the following switching configuration: the compressor unit 5 is stopped as a result of the predefinition $S_{5,t}=0$. Since the required volume flow of the compressor plant can now be achieved with two of three compressor units, the compressor unit 5 is switched off. All the compressor units 3 and 4 now in operation will then be run continuously until the change in the volume flow or a deviation from the set points again results in an optimization calculation with a changed switching configuration. Continuous mode of operation means that the compressor units in operation are operated with an optimized load distribution and with an optimized setting of their working points 22 in the characteristic maps 20. The output variables 32 of the optimization module 11, in addition to the switching states of the compressor units currently to be set, thus also contain a rotational speed set point predefinition $\lambda_i$ for the individual compressor units 3, 4 and 5.

The rotational speed set points $\lambda_i$, before being given to the compressor unit controller, are scaled by a common factor $\alpha$ by the subordinate station controller, which runs at a higher cycle rate than the optimization, in order to adjust the set points. The optimization calculation is designed to be self-triggering with a control cycle R in the optimization module 11. During the optimization calculation, therefore, cyclically in addition to the calculation of a possible switching configuration $S_{i,t}$, the load distribution between the compressor units, that is to say the efficiency of optimal rotation speed set points $\lambda_i$ for the individual compressor units 3, 4 and 5, is carried out cyclically. For the duration of the control cycle R, the rotational speed set points $\lambda_i$ and the switching configuration $S_{i,t-1}$ are kept constant. Then, if the volume flow $\dot{V}_{g(set\ point)}$ of the overall plant is doubled on account of load changes, the optimization calculation will predefine a new switching configuration $S_{i,t}$, a new load distribution and a new position of the optimal-efficiency working points 22 with the next control cycle R.

The new switching configuration now says to operate three of three compressor units. Since the result of the optimization calculation is known before the end of the control cycle, a warm-up phase is started for the third compressor unit 5 to be started up. With the completion of the control cycle R, the new values are provided to the control device 10 and in particular to the compressor unit controllers 13, 14, 15. The compressor unit 5 previously prepared with a warm-up phase can now be connected seamlessly for the new control cycle R and the optimal total energy consumption for the required delivery output or the required volume flow $\dot{V}_{g(set\ point)}$ is reproduced.

FIG. 2 shows a compressor-specific characteristic map 20 of a compressor unit 3. The compressor characteristic map 20 shows the rotational speed-dependent delivery characteristic 21 and the efficiency characteristic 23 of the compressor as a function of the volume flow $\dot{V}_{3,E}$ at the inlet to the compressor, plotted on the x axis, and the specific delivery work $y_3$ of the compressor, plotted on the y axis ($\dot{V}=\dot{m}/\delta$, $\delta$=density).

Also plotted is a pump limit 36. Efficiency-optimal working points 22 lie close to the pump limit 36 on an efficiency characteristic 23 with a high efficiency $\eta_{3,max}$. For the method described with FIG. 1, the characteristic maps 20 are given as a mathematical function of a mass flow (or the volume flow) and a specific delivery work of the individual compressor units. The mathematical formulation of the characteristic maps 20 as a computational function is a constituent part of the optimization module 11 and of the optimization calculation.

Figure 3:
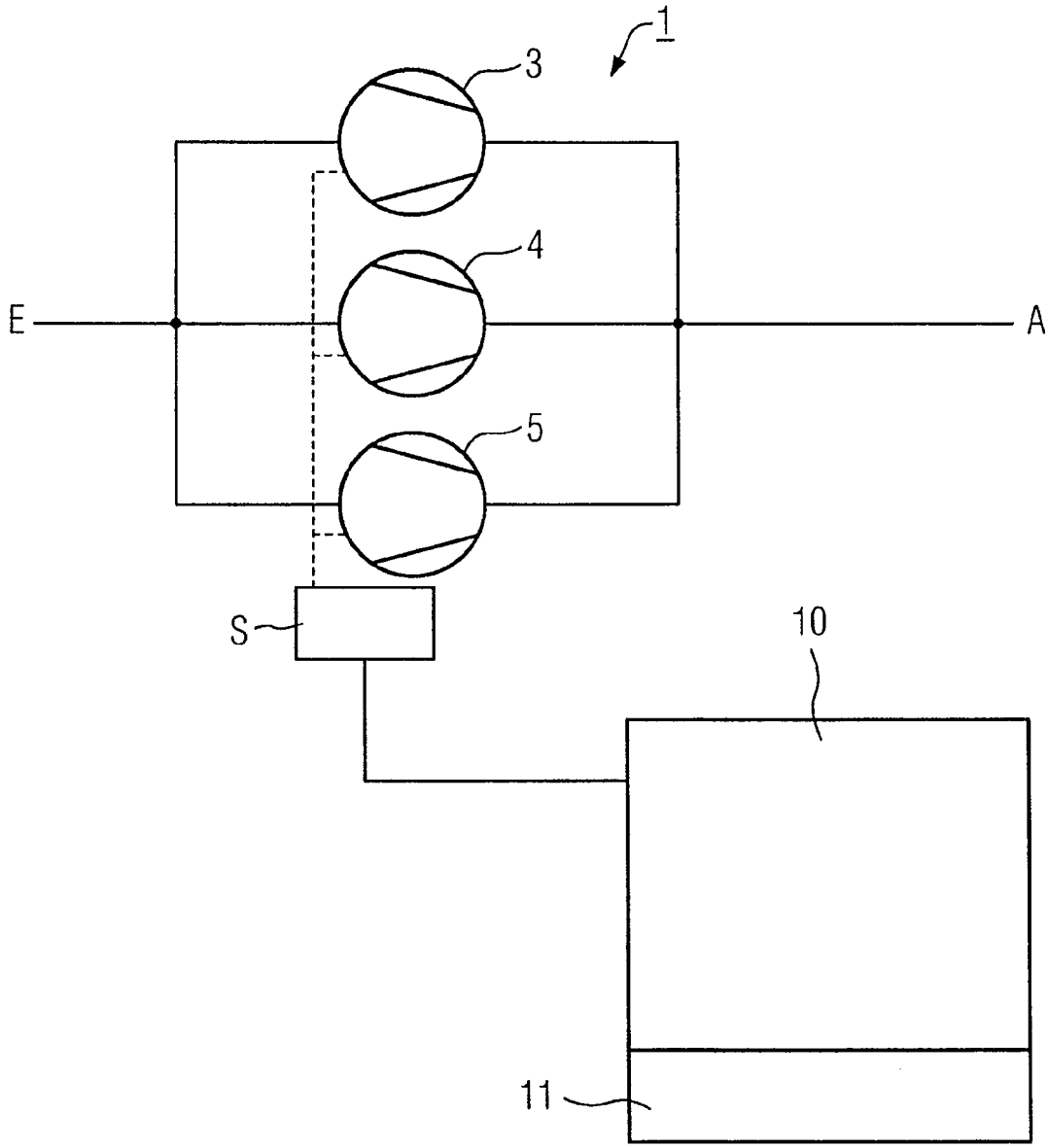

FIG. 3 shows a control device 10 for controlling a compressor plant 1. The optimal rotational speed set points $\lambda_i$ determined by the optimization module 11 and the new switching configuration $S_{i,t}$ are set and/or regulated via an actuating module $S_{i,t}$ on the compressor units 3, 4 and 5 in interaction with the control device 10.

The controlled variable used for the control action of the control device 10 is in particular that variable comprising flow, intake pressure, end pressure and end temperature which exhibits the smallest positive control deviation. The control action of the control device 10, together with the optimization module, supplies the set points for the one individual compressor unit controller 13, 14, 15 as output, see FIG. 2.

Figure 4:
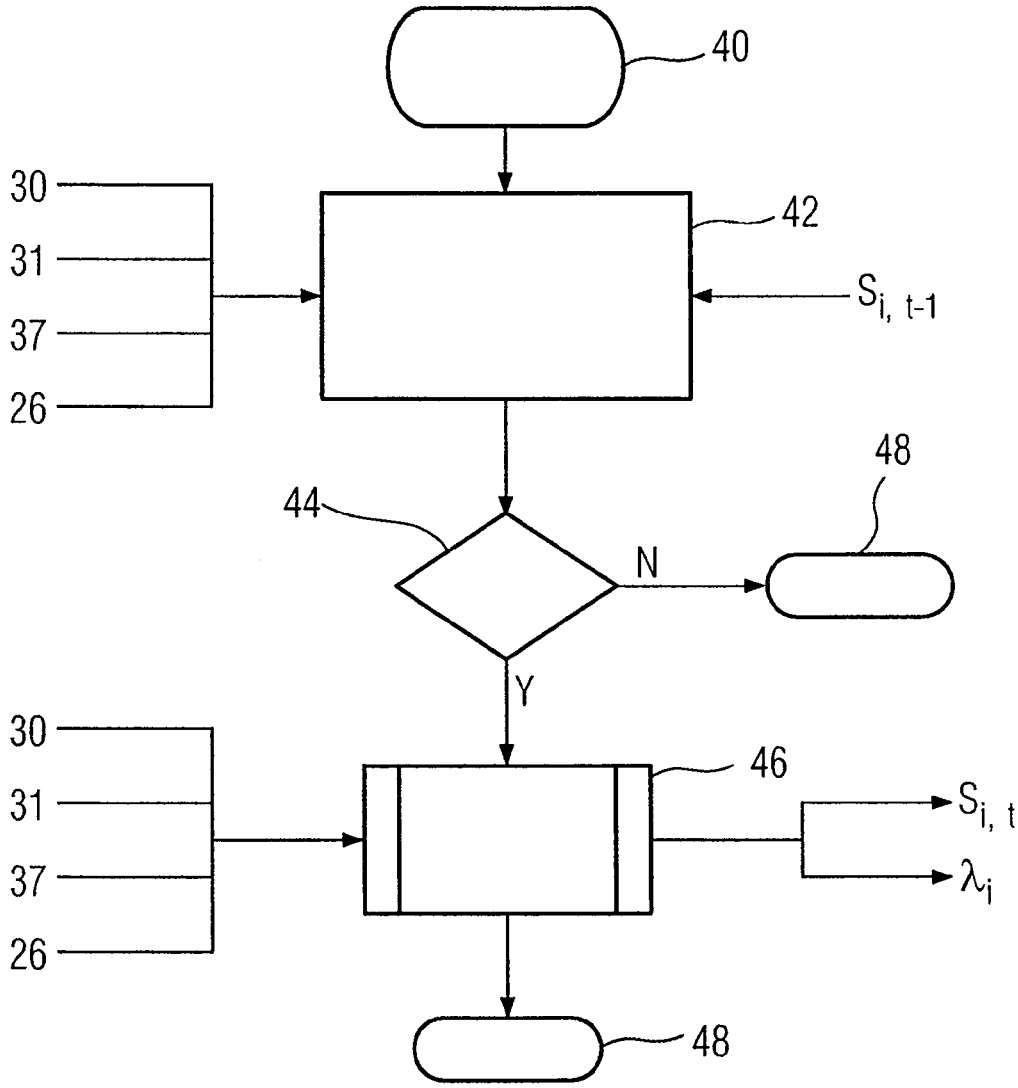

FIG. 4 shows a flowchart of the method steps 40, 42, 44 and 46. Starting from a first method step 40, the optimization method is initiated cyclically. With a second method step 42, the current state of the compressor station 1 is determined. For this purpose, the following values are registered: actual values 30, set points 31, limiting values and boundary conditions 37 and models 24*a*, 24*b* and 24*c* from the model library 26. In addition, according to various embodiments, the current switching state $S_{i,t-1}$ of the compressor plant 1 is determined. A third method step 44 constitutes a decision point. With the third method step 44, the decision is made to carry out an optimization calculation 46 in a fourth method step or to end 48 the method. On the basis of the present actual values 30 and set points 31, it is possible to decide whether an optimization calculation is necessary. For the case in which the third method step results in a yes decision Y, the method is continued with the fourth method step 46. In the fourth method step 46, the mixed integer optimization problem is solved. Input variables for the fourth method step 46 are once more actual values 30, set points 31, limiting values and boundary conditions 37 and the models from a model library 26. As a result of the fourth method step 46, rotational speed set points $\lambda_i$ and new switching states $S_{i,t}$ are output. The method is ended 48. With the cyclic initiation from the first method step 40, the method is run through again.

What is claimed is:

1. A method for controlling a compressor plant having at least two compressor units, having a plurality of devices for changing the operating output of the compressor units and having a control device, the method comprising the steps of:

in the event that new set points are predefined or there is a change in the current state of the compressor plant, using an optimization calculation to calculate a new switching configuration from a current switching configuration of the compressor units, with regard to an optimized total energy demand of the compressor plant, and setting the new switching configuration automatically via the control device.

2. The method according to claim 1, wherein a forecast for at least one future time, is determined using the optimization calculation.

3. The method according to claim 1, wherein compressor unit-specific data sets and/or compressor unit-specific characteristic maps are evaluated and, for the individual compressor units, working points are determined, which depend on predefined or changed values of the mass flow and a specific delivery work, the working points being set in such a way that the total energy demand of the compressor plant is optimized.

4. The method according to claim 3, wherein the data sets and/or characteristic maps are provided as a function of the mass flow or a corresponding volume flow and a specific delivery work of the individual compressor units.

5. The method according to claim 1, wherein during the optimization calculation, in addition to the switching configuration, a load distribution between the compressor units is calculated and is changed if necessary.

6. The method according to claim 1, wherein the optimization calculation is carried out with a control cycle, in particular in a self-triggering manner.

7. The method according to claim 6, wherein, with each control cycle, rotational speed set points and/or the new switching configuration for the control device are provided as output variables from the optimization calculation.

8. The method according to claim 7, wherein, for the duration of the control cycle, which, in particular, is a multiple of a cycle time of the control action of the control device, the rotational speed set points and/or the switching configuration are kept constant.

9. The method according to claim 7, wherein the rotational speed set points are scaled with a common factor and used as a set point for a compressor unit controller.

10. The method according to claim 1, wherein the control device, using the new switching configuration, triggers a warm-up phase of the compressor units for the subsequent connection of a compressor unit that was previously out of operation, even before the end of the control cycle.

11. The method according to claim 1, wherein, with the end of the warm-up phase, a readiness to be loaded for the next control cycle is communicated to the control device.

12. The method according to claim 1, wherein the following are evaluated as an input for the optimization calculation:

a model of the individual compressor units and/or a model library of the entire compressor plant, and/or a current specific delivery work of the individual compressor units and/or a current specific delivery work of the compressor plant and/or a current mass flow through the individual compressor unit, in particular through an individual compressor, and/or a current mass flow through the compressor plant and/or the current switching configuration and/or an intake pressure on the inlet side of the compressor plant and/or an intake pressure on the inlet side of the individual compressor unit and/or an end pressure on the outlet side of the compressor plant and/or an end pressure on the outlet side of the individual compressor unit and/or a temperature on the outlet side of the compressor plant and/or a temperature on the inlet side of the compressor plant and/or a temperature on the outlet side of the individual compressor units and/or a temperature on the inlet side of the individual compressor units and/or the current rotational speeds of the compressor units,

13. The method according to claim 1, wherein the optimization calculation minimizes the total energy demand expected at a later time using forecast calculations in accordance with the principle of model-predictive control,

14. The method according to claim 1, wherein an energy consumption of a switching operation is taken into account during the optimization calculation,

15. The method according to claim 14, wherein the energy consumption of the switching operation is calculated from the data sets and/or the characteristic maps of the compressor units.

16. The method according to claim 1, wherein the specific delivery work of the compressor plant is assumed to be constant for the control cycle, in particular when the compressor units are connected in parallel.

17. The method according to claim 1, wherein the mass flow of the compressor plant is assumed to be constant for the control cycle, in particular when the compressor units are connected in series.

18. The method according to claim 1, wherein an active compressor unit is operated at least with a predefined or predefined minimum flow.

19. The method according to claim 1, wherein the optimization calculation includes a branch and bound algorithm.

20. The method according to claim 19,wherein a limit for the branch and bound algorithm is determined by solving a relaxed problem using sequential quadratic programming.

21. The method according to claim 1, wherein the optimization calculation solves partial problems using dynamic programming, in particular in the case of series connection.

22. A control device for controlling a compressor plant comprising:

at least two compressor units having a plurality of devices for changing the operating output of the compressor units, an optimization module, with which, in the event that new set points are predefined or there is a change in the current state of the compressor plant, an optimization calculation is used to calculate a new switching configuration from a current switching configuration of the compressor units, with regard to an optimized total energy demand of the compressor plant, and an actuating module, with which the new switching configuration can be set automatically.

23. The control device according to claim 22, wherein the optimization module is arranged at a physical distance, in particular a plurality of km, from the control device.

24. The control device according to claim 22, wherein the optimization module is set up to take into account an energy consumption of a switching operation.

25. The control device according to claim 22, wherein the optimization module is set up for the optimization calculation for a plurality of control devices of a plurality of compressor plants.

26. A computer program product embodied in a computer readable data storage medium, the computer program containing software which when executed on a computer for controlling a compressor plant having at least two compressor units, having a plurality of devices for changing the operating output of the compressor units and having a control device, perform the steps of:

in the event that new set points are predefined or there is a change in the current state of the compressor plant, using an optimization calculation to calculate a new switching configuration from a current switching configuration of the compressor units, with regard to an optimized total energy demand of the compressor plant, and setting the new switching configuration automatically via the control device.

* * * * *